United States Patent [19]

Gelin et al.

[11] 3,966,132

[45] June 29, 1976

[54] APPARATUS FOR AND METHOD OF HANDLING LINEAR ELEMENTS

[75] Inventors: Robert J. Gelin, Newark, Ohio; James E. Bartlett, Big Pine Key, Fla.

[73] Assignee: Owens-Corning Fiberglas Corporation, Toledo, Ohio

[22] Filed: Aug. 1, 1974

[21] Appl. No.: 493,580

Related U.S. Application Data

[63] Continuation of Ser. No. 348,343, April 5, 1973, abandoned.

[52] U.S. Cl. ..... 242/36; 200/61.18; 242/18 G; 242/37 R; 242/42; 242/45

[51] Int. Cl.[2] ..... B65H 63/00

[58] Field of Search ..... 242/36, 37 R, 38, 42, 242/49, 28, 45, 29, 18 G; 226/10, 11, 24, 45; 200/61.17, 61.18; 340/259

[56] References Cited

UNITED STATES PATENTS 3,189,288 6/1965 Petersen ..... 242/37 R 3,613,065 10/1971 Lindemann et al. ..... 200/61.18 X

*Primary Examiner*—Stanley N. Gilreath

*Attorney, Agent, or Firm*—John W. Overman; Ronald C. Hudgens

[57] ABSTRACT

Method of and apparatus for producing roving with a controlled number of strands including means for linearly advancing each of the strands along a given path; strand motion detection means effective to sense movement of each of the strands during its advancement and to supply individual motion signals for each of the strands in response to the sensed movement; and means responsive to the frequency of the individual intermittent motion signals for controlling the strand advancing means.

11 Claims, 6 Drawing Figures

APPARATUS FOR AND METHOD OF HANDLING LINEAR ELEMENTS

This is a continuation, of application Ser. No. 348,343, filed Apr. 5, 1973 now abandoned.

BACKGROUND OF THE INVENTION

Textile operations often require simultaneously handling of many continuous linear elements, such as yarns or strands, to produce a product. Examples of such operations are roving and beaming. And the quality of the product depends upon the ability of apparatus to keep a positive end count of the linear elements being processed. So apparatus cannot be allowed to blithely operate without monitoring the movement of the linear elements during processing.

It has been a practice to produce a composite roving by withdrawing strands or rovings from packages held in creels and converging the strands or rovings into a group and winding the group on a rotatable packaging tube, collet or collector. It has been found that one of the major problems in producing such a composite linear product lies in maintaining a positive end count of the number of strands or rovings being combined. The specifications for different products vary, but there has been an increased requirement for accuracy in maintaining a predetermined number or minimum number of rovings or strands in the composite product. Thus, a need has developed for increased reliability and durability in control to meet specifications for a composite roving with a positive end count, or generally combining linear bodies into a composite product.

Apparatus has been used that performed an end count function as an incidental control in effecting a required tension on each strand to provide a composite roving made up of individual rovings having a substantially uniform tension. In U.S. Pat. No. 3,361,375 issued Jan. 2, 1968, an end count was provided by a drop member or drop wire held in elevated position by the tension of the roving threaded through a guide eye in the drop member. When the roving broke, the member normally fell to close a switch that effected interruption in the operation of a winding motor and a feed roll motor. While the above described approach was satisfactory for use in the device as described, difficulties were encountered. The apparatus as a whole was primarily a tension sensing and tension controlling device. Thus, if a tension controlling portion of the apparatus failed, it was possible to obtain a breakout signal although no strand was broken. Further, abrasion on the strand or roving may mechanically reduce the strength of the strand or roving and may further interfere with the functioning of the tensioning devices. In addition, breakage of the strand or roving at certain points of the apparatus may not be detected by the device since the licking or wrap around capabilities of a filament or strand may effect sufficient tension in the area of the drop wire or member supported by the strand to maintain support of the drop wire detecting member even though the strand is broken.

Further, apparatus has been used that performs an end count function by providing a motion signal changing in magnitude with changes in the motion of the linear elements and control circuit responsive to the magnitude of the motion signals. For example, tachometer generators and piezoelectric crystals have been used. But these prior devices tend to be too frail and expensive for production use.

Improved controls have been needed.

SUMMARY OF THE INVENTION

An object of the invention is improved apparatus for and method of processing one or more continuous linear elements such as glass strands;

Another object of the invention is improved apparatus for and method of producing a roving with a controlled number of strands.

These and other objects are attained by apparatus including: means for linearly advancing a continuous linear element; means for sensing the motion of the linear element during its advancement and for supplying intermittent motion signals in response to the sensed motion of the element; and means responsive to the intermittent motion signals for controlling the linear element advancing means.

Other objects and advantages will become apparent as the invention is described in more detail with reference made to the accompanying drawings.

SHORT DESCRIPTION OF THE DRAWINGS

DESCRIPTION OF THE PREFERRED EMBODIMENTS

The apparatus for and method of processing linear elements according to the invention are especially useful in processing multifilament linear textile elements, for example glass strand, into roving. But the invention is useful in processing other types of continuous linear elements. And the invention can be used in other types of operations, for example textile beaming.

Figure 1:
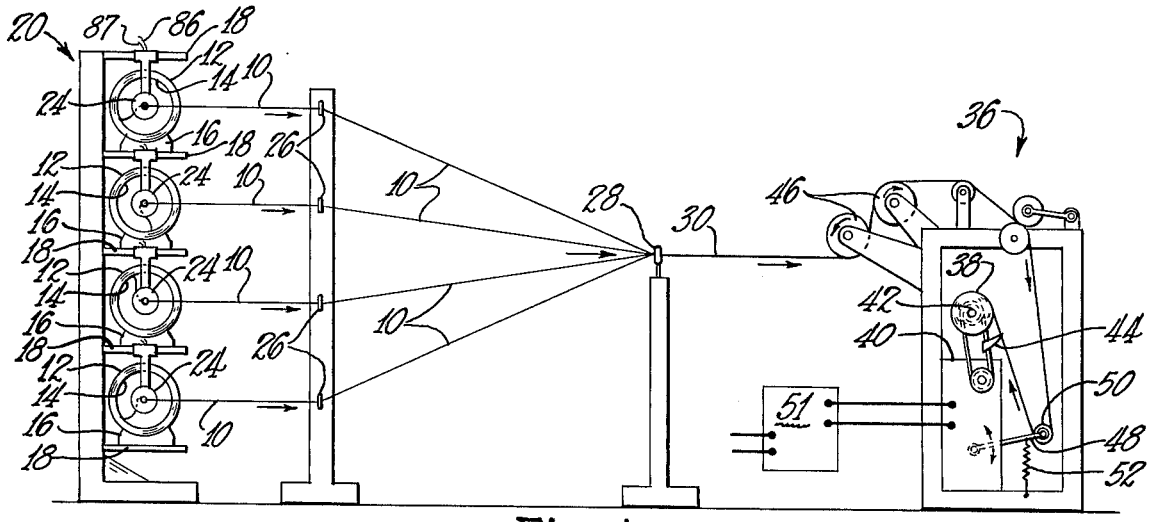
FIG. 1 is a simplified side elevation view of apparatus for producing roving from strand according to the principles of the invention.

FIG. 1 illustrates apparatus for producing glass roving according to the principles of the invention. A single collection means withdraws a continuous filaments glass strand from the interior ("inside" withdrawal) of individual serving packages each having a hollow central region. The glass strands are withdrawn from one end of the packages and are turned to be gathered into a bundle of roving; the roving is collected into a single wound package. An individual strand motion detection means, which also functions as a strand guide, is immediately adjacent the exit end of each of the pacakges. And these detection means supply intermittent motion signals in response to sensed strand motion during advancement of the individual strands. Means responsive to the intermittent motion signals controls the collection means.

In the specific embodiment illustrated in FIG. 1 the control means stops the collection means if a selected number of strand motion sensing devices (monitoring stations) indicate intermittent motion signals below a predetermined frequency. For example, the controls can be set to shut-off the collection means when the frequency of the motion signal from a single motion sensing device falls below predetermined frequency.

Figure 2:
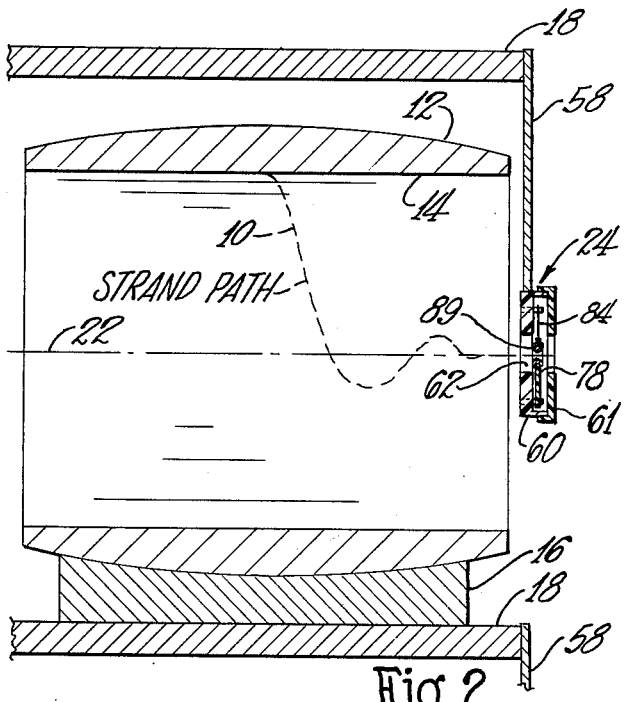
FIG. 2 is an enlarged side elevation view in cross section of one of the serving packages and strand motion sensing devices shown in FIG. 1.
Figure 3:
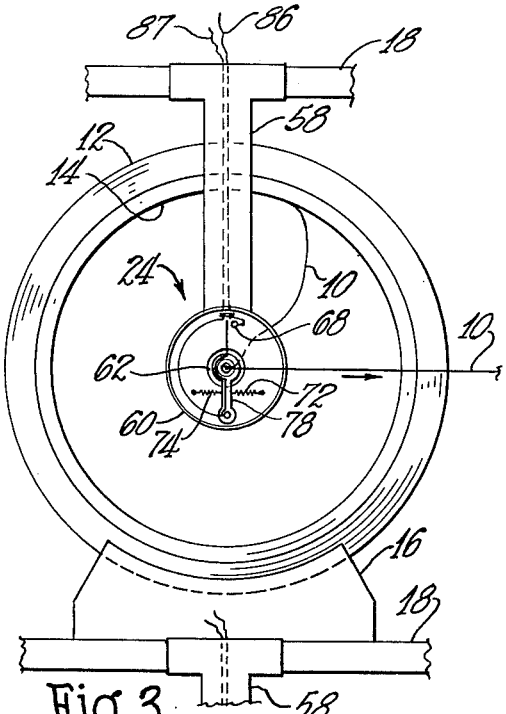
FIG. 3 is a front elevation view of the package and the strand motion sensing device shown in FIG. 2.

Referring to FIGS. 1–3, individual glass strands 10 are withdrawn from one end of individual wound serving packages 12 that have axial passageways or hollow central regions 14 extending therethrough. The packages 12 rest on cradles 16 each supported on a horizontal shelf 18 of a creel 20. So each of the packages 12 has its longitudinal axis disposed horizontally; the dashed line in FIG. 2 denoted by the reference numeral 22 indicates the horizontal axis of the illustrated package 12.

Four strands 10 are shown in the embodiment. But in practice it is common to process up to one hundred and more strands into a roving.

Each of the strands 10 is advanced in an axial direction through a guide opening in a strand withdrawal guide and motion sensing device 24. The advancing strands 10 are turned or bent on the individual devices 24, which senses strand motion. From the devices the strands 10 are advanced laterally of the packages 12 and through separate external strand guides 26 spaced from the creel 20. A strand gathering guide 28 beyond the individual guides 26 combines or gathers the individual strands 10 into a bundle or roving 30.

A conventional textile take-up machine 36 is shown as the means for collecting the roving 30 into a wound package 38. The machine 36 includes a variable speed drive 40 for rotating a package collecting spool or mandrel 42, a strand transversing guide 44, a pair of constant speed feed rolls 46 and a pivotally mounted speed control arm 48 with a rotatable pulley 50 mounted on its free end. The roving 30 is advanced between the driven rolls 46 downwardly to the pulley 50 on the end of the speed control arm 48. The roving 30 turns on the pulley 50 and is advanced upwardly to collect on the driven spool 42. The strand transversing guide 44 engages the roving 30 adjacent the collecting package 38 to reciprocate the roving 30 lengthwise of the collecting spool during package formation.

Controls in a box 51 control the operation of the take-up machine 36 in response to strand motion sensed by the devices 24.

The take-up machine 36 is responsive to tension in the advancing roving 30. The rolls 46 advance the rovings 32 to the collecting spindle 42 via the speed control arm 48 and the pulley 50. The arm 48, which includes electro-mechanical devices within the variable speed drive 40 (including a variable drive motor), controls the rotational speed of the spool 42 to keep a substantially constant tension in the roving 30 during collection. A spring 52 biases the arm 48 to introduce a selected tension into the roving 30 between the driven rolls 46 and the collecting spool 42.

FIGS. 2 and 3 show one of the motion sensing devices 24, which as illustrated includes a support with a neck 58 and a hollow disc 60. The hollow disc 60 has an opening 62 in its central region through which strand travels during strand withdrawal and collection.

Figure 4:
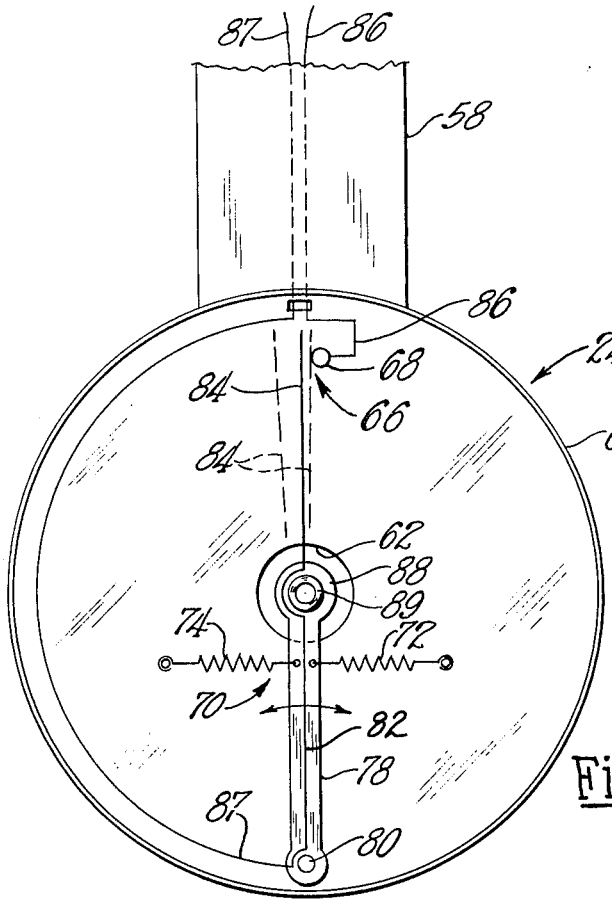
FIG. 4 is a still further enlarged front elevation view illustrating in more detail motion sensing apparatus within the motion sensing device shown in FIGS. 1–3.

FIG. 4 shows the mechanism within the hollow disc 60. The mechanism is a switch 66 that is opened and closed by strand movement during strand withdrawal from the packages 12. The switch 66 includes a stationary electrical contact 68 and a movable electrical contact assembly 70 resiliently held in a normally open position or relationship with the fixed contact 68. Opposing tension springs 72 and 74 cooperate to hold the contact assembly 70 in its normally open position.

The assembly 70 includes a base 78 of dielectric material pivotally mounted for movement about a support pin 80 and an electrical conductor 82 including a contact whisker portion 84 extending from the free end of the base 78. The conductor 82 is wire of conductive material, e.g. silver alloy; the conductor 82 extends through and moves with the base 78. Electrical leads 86 and 87 are connected to the fixed electrical contact 68 and the conductor 82 respectively. The electrical leads 86 and 87 extend through the elongated neck 58 of the support. Lead 86 connects to ground and the lead 87 connects to an electrical control circuit.

The base 78 is enlarged at its free end to include an annular portion 88 that holds a tubular member 89 forming a guide eye through which strand is advanced. The opening 62 and the passageway (guide eye) of the tubular member 89 are generally aligned to provide a passageway for strand through each device 24.

The member 89 is made of material that is not abrasive to glass filaments. In practice members 89 made of graphite have given good results.

With the switching mechanism 66 a strand 10 is advanced from the interior of a package 22 and turned or bent on the movable contact assembly 70 as it travels through the passageway (guide eye) of the member 89. And linear advancement of the strand 10 effects (together with the cooperation of the springs 72 and 74) movement of the assembly 70 to open and close the switch (contacts 68 and 82) as indicated in FIG. 4.

It is believed the switch 66 is opened and closed by changes in tension in the strand during advancement. These tension changes in the strand may be caused by changes in the location of strand removal from the interior of the package during ballooning withdrawal from the package. Variations in strand adherence to the package may also contribute to tension changes in the strand during withdrawal. The result is intermittent closing of the switch 66.

Outside withdrawal from one end of a serving package can be used. Also, other types of serving packages, such as a yarn package, can be used.

Figure 5:
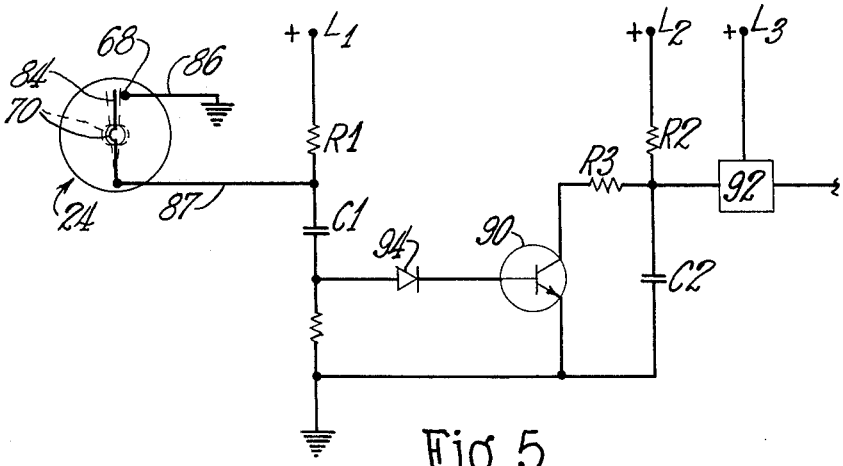
FIG. 5 is a circuit forming part of the controls for the apparatus shown in FIG. 1. The circuit operates directly with the motion sensing apparatus shown in more detail in FIG. 4.

FIG. 5 illustrates a detection circuit that is responsive to strand motion sensed by one of the devices 24 and that provides an intermittent control signal in response to the sensed motion. There is a detection circuit for each device 24.

The intermittent motion signals control the operation of a transistor 90 used as an on-off switch. And the transistor 90 controls the operation of a Schmidt trigger 92. In the circuit a capacitor C1 is charged through a resistor R1 by a positive DC voltage applied at $L_1$. The lead 87 from the strand motion sensing device 24 forms a junction with the circuit between the capacitor C1 and the resistor R1. So when the switch 66 is closed (contacts 68 and 82), the voltage applied at $L_1$ through resistor R1 is grounded and the capacitor C1 is discharge. When a strand 10 is advanced through a device 24, its switch 66 is continually being opened and closed by the motion of the advancing strand 10. Accordingly, during strand advancement through a device 24 the capacitor C1 is being alternately charged and discharged.

The capacitor C1 is electrically connected to the base of the transistor 90 through a blocking diode 94. The transistor is turned-on by the biasing voltage applied to the base of the transistor 90 during times the capacitor C1 is charged (the switch 66 is open). Similarly, the transistor 90 is turned-off when the capacitor C1 is discharged (the switch 66 is closed). So the transistor 90 is alternately being opened and closed by the charging and discharging of the capacitor C1 during strand withdrawal.

The blocking diode 94 provides high impedance protection to the transistor 90 during times the capacitor C1 is discharging.

The control circuit of FIG. 5 also includes a firing capacitor C2. This capacitor is charged through a resistor R2 by positive DC voltage applied at $L_2$. The capacitor C2 is charged during times the transistor 90 is turned-off; similarly, the capacitor C2 is discharged to ground through a resistor R3 and the transistor 90 during times the transistor 90 is turned on by the base biasing voltage developed at the capacitor C1.

The capacitor C2 controls the operation of the trigger 92. During normal strand withdrawal speeds the switch 66 is opened and closed sufficiently often by the strand. The capacitor C2 is prevented from being charged sufficiently to activate or trigger the trigger 92. In other words, the transistor 90 is closed sufficiently often to discharge the capacitor C2 often enough to keep the charging voltage below the firing voltage for the trigger 92. However, if the frequency of the transistor closing becomes too low, the capacitor C2 will charge sufficiently to fire the trigger 92. It is possible to modify the rate at which the capacitor C2 is charged. For example, one might change the voltage applied at $L_2$ or vary the resistance of R2.

The trigger 92 is supplied a positive DC voltage from $L_3$. And this voltage appears as a steady positive voltage from the trigger 92 so long as the trigger 92 is activated. So when a strand 10 breaks, the intermittent signal from its movement ceases and associated trigger 92 supplies a steady output voltage signal. But during normal strand withdrawal the frequency of the motion signals is sufficient to keep the capacitor C2 below the firing voltage of the trigger 92. Hence, there is no output voltage signal from the trigger 92 during normal strand withdrawal.

In the embodiment shown each of the motion sensing devices 24 electrically connects to an individual detector circuit as shown in FIG. 5.

Figure 6:
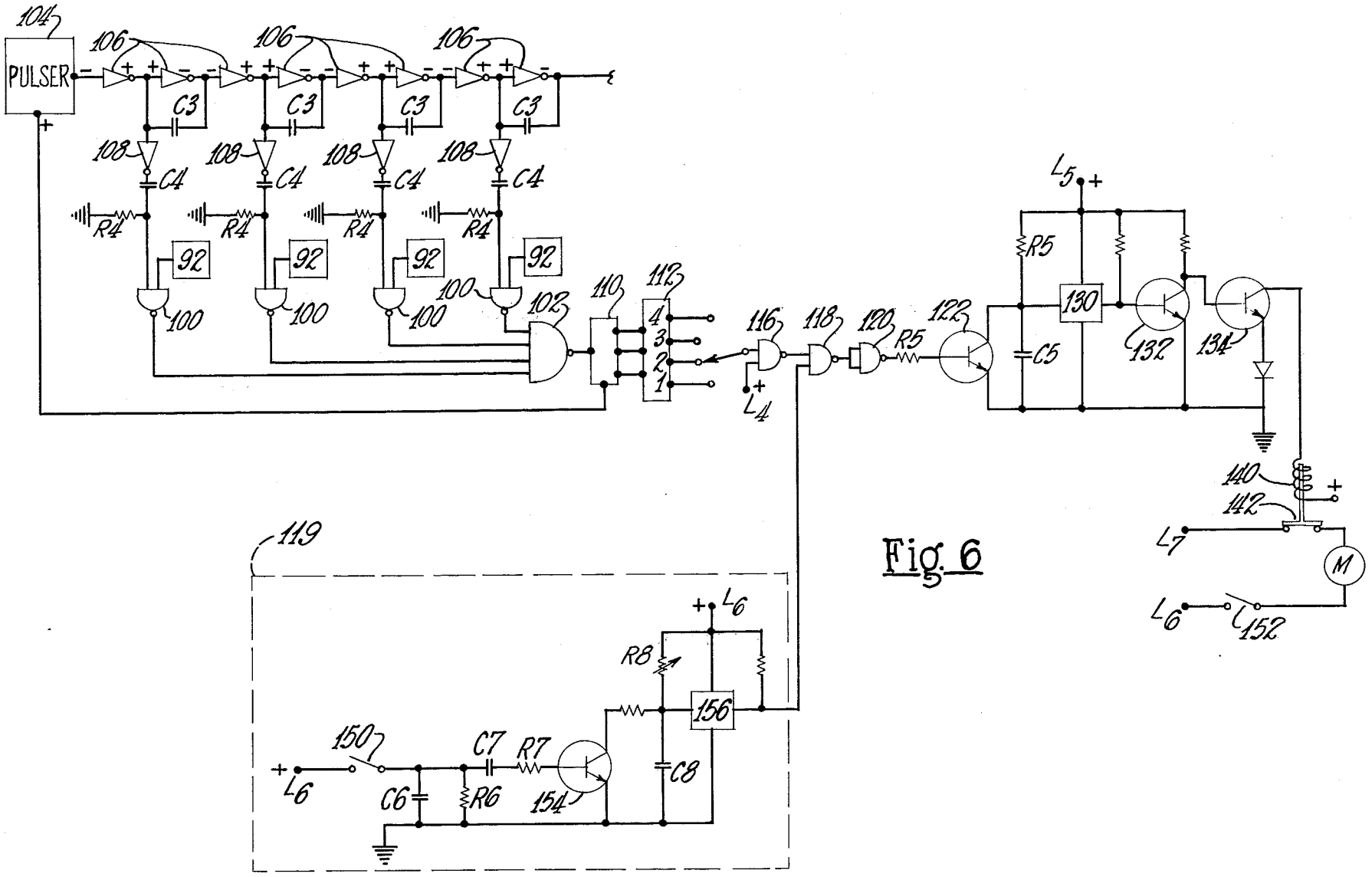
FIG. 6 illustrates an electrical circuit for the other controls of the apparatus of FIG. 1. This circuit receives electrical signals from individual circuits like the circuit shown in FIG. 5.

FIG. 6 illustrates additional controls for operation of the apparatus of FIG. 1. These controls are effective to shut-off the take-up machine 36 when the speed of a selected number of the strands 10, as sensed by the device 24, falls below a selected speed. In practice, the controls are normally used to shut-off the machine 36 when a selected number of strands 10 break. In other words, the machine 36 is shut-off when there is no motion signals from a selected number of strands.

As shown in FIG. 6, the Schmidt trigger 92 in each of the detector circuits shown in FIG. 5 connects as an input to a double input NAND gate 100.

A scan signal is supplied as the other input to each of the gates 100.

There is an output voltage signal from each of the gates 100 when there is only one input voltage signal. In other words, each of the gates 100 must have simultaneously supplied to it both a scan signal input and a signal input from one of the triggers 92 to stop its output signal. Otherwise there is a steady voltage signal from each gate 100. So when all 4 strands shown in FIG. 1 are running properly each of the gates 100 supply a steady voltage signal to a 4 input summing NAND gate 102.

A scanning signal is supplied periodically to each of the gates 100 through a pulse shaping and delay network. As shown in FIG. 6 a square-wave pulser 104 periodically supplies voltage signals to a string of electrically connected inverters 106. Each alternate inverter 106 has a bridging capacitor C3 between its input and output. Consequently, this network provides a time lag where each alternate inverter 106 and its associated capacitor C3 combination provides a delay. A voltage signal from pulser 104 is thereby divided into discrete or separated pulses each providing an input to an individual NAND gate 100. And these input pulses are provided in sequence to individual legs of the circuit.

Each scan signal travels to the input of each of the gates 100 through a pulse shaper 108 and a differentiating network including a capacitor C4 and a grounded resistor R4. Each time the pulser 104 supplies a scanning pulse an input voltage signal is supplied to each of the gates 100 before the pulser 104 supplies another signal. If there is no companion voltage signal from the detector circuit of FIG. 5 (a trigger 92), each of the gates 100 continues to supply a constant positive voltage output signal. If a voltage signal from trigger 92 combines with a scan pulse, the output from the effected gate 100 drops to zero for the remaining duration of the scan time.

The output of the summing NAND gate 102 electrically connects to a digital counter 110 that operates in a conventional manner. From the output of the gate 102 the counter 110 registers the number of zero signals received from the gates 100 during each scan. For example, if there are two broken strands 10, the gate 102 will receive an individual zero signal from each of the effected gates 100. This will result in two zero signal pulses from the summing gate 102. And the counter 110 will register these.

The pulser 104 supplies a reset signal to the counter 110. Hence, upon completion of a scan signal from the pulser 104, which can result in a registered count in the counter 110, the reset signal from the pulser 104 clears the counter 110. The reset signal is 180 degrees out of phase with the scan signal.

The counter 110 connects to a digital decimal decoder 112 that operates in a conventional manner. The decoder stops its output signal upon receiving a signal indicating a selected number of strands 10 are being improperly advanced, e.g. are broken. In FIG. 6 the decoder 112 is set for two strand breaks.

The output of the decoder 112 is connected as an input to a two input NAND gate 116. The other input to the gate 116 is a steady positive voltage applied at $L_4$. So when the input from the decoder 112 is positive, the output of the gate 116 is zero. Conversely, when the decoder 112 reaches the selected count (selected number of strand breaks) and its signal becomes zero, the output from the gate 116 becomes positive.

The output of the gate 116 is one of two inputs to a two input NAND gate 118; the other input to the gate 118 is from an inhibit stop circuit 119 that inhibits the operation of the control circuit of FIG. 6 during start-up of the take-up machine 36.

The gate 118 supplies a no signal output only upon receipt of a positive input from the gate 116 and a positive signal from the inhibit stop circuit 119. And this occurs only when the signal from the decoder 112 drops to zero and there is a positive signal from the inhibit stop circuit 119.

The output from the gate 118 is the input to an inverter 120. The output of the inverter 120 goes to the base of a transistor 122 through a resistor R5.

The transistor 122 is an on-off switch that controls a command circuit including a Schmidt trigger 130, a transistor 132 and a transistor 134.

The firing capacitor C5 of the command circuit is charged through a resistor R5 by positive DC voltage applied at $L_5$. Since the transistor 122 is normally open, the Schmidt trigger 130 is normally held activated by the charged capacitor C5. So the trigger 130 normally supplies a positive voltage output signal. And this output is supplied to the base of the transistor 132. So the transistor 132 is normally closed. Thus, in normal strand running conditions, the transistor 132 is closed and the transistor 134 is open.

The transistor 134 controls energization of a control coil 140. And the coil 140 opens and closes a switch 142 that is in the circuit supplying electrical energy to the drive motor M of the take-up machine 36. Electrical energy is applied across leads $L_6$ and $L_7$.

At start-up the switch 150 (in the inhibit circuit 119) and the switch 152 (in the motor electrical supply circuit) are closed. A positive voltage (supplied at $L_6$) is applied to the inhibit circuit of the controls upon closing the switch 150; electrical energy is supplied to the drive motor M of the take-up machine 36 upon closing the switch 152.

Closing the switch 150 effects only a pulsed voltage to the base of a transistor 154 in the inhibit circuit 119 because of a RC network including capacitors C6 and C7 and resistors R6 and R7. This pulse closes the transistor 154 to discharge a firing capacitor C8 to ground. And such discharging resets the capacitor C8 for timed charging. The transistor 154 immediately opens and the capacitor C8 is charged through variable resistor R8 from positive DC voltage applied at $L_6$.

The capacitor C8, upon being sufficiently charged, fires a Schmidt trigger 156. The trigger 156 in turn gives a steady positive voltage signal to the gate 118 throughout package formation by the take-up machine 36.

It is possible to vary the time for charging the capacitor C8 by changing the resistor R8. And in practice this is done to activate the controls for the particular start-up time needed or wanted for the take-up machine 36.

In operation an operator begins build of a package 38 by closing switches 150 and 152. As the take-up machine 36 accelerates to speed, the inhibit circuit keeps its input to the gate 118 zero. So the controls permit the strands 10 to be advanced without regard to their motions until the inhibit circuit supplies a positive input to the gate 118.

During package build the strand motion detection means senses the motion of each of the strands 10 during its advancement and supplies intermittent electrical motion signals for each of the strands 10. And control means responsive to the motor signals controls the means for advancing the strands. As shown these control means shut-off the take-up machine 36 when a selected number of strands are broken. But other functions can be performed. For example, the controls might be used to turn on lights or ring alarms to alert an operator that a number of strands 10 are broken.

We claim:

1. The method of handling a linear bundle of filaments comprising:

linearly advancing the bundle along a given path such that the bundle vibrates with a varying frequency in response to changes in the linear speed and tension of the advancing bundle;

sensing the frequency of the vibrations of the advancing bundle;

supplying an electrical signal having a fixed amplitude and a varying frequency corresponding to the frequency of the vibrations of the advancing bundle; and controlling advancement of the linear bundle in response to the varying frequency of the electrical signal.

2. Apparatus for handling a linear element comprising:

means for linearly advancing a linear element along a given path;

detection means effective to sense the motion of the element during its advancement including a movably mounted guide member upon which the linear element is turned during advancement and an electrical circuit including a switch for controlling electrical signals from the circuit in response to the motion of the linear element, the electrical switch comprising a fixed electrical contact and an electrical conductor carried by and moving with the movable guide member, such electrical conductor including a portion projecting from the guide member so that such portion will be moved by the linear element during advancement thereof to intermittently contact the fixed electrical contact and thereby supply intermittent pulse-like electrical signals having a varying frequency and period of duration and a fixed amplitude corresponding in frequency and period of duration to the opening and closing of the switch effected by the linear element; and another electrical circuit responsive to the varying frequency of the intermittent pulse-like electrical signals for controlling the linear element advancing means.

3. Apparatus of claim 2 in which the movable guide member defines a guide opening through which the linear element is advanced.

4. Apparatus of claim 3 in which the guide member is pivotally mounted.

5. Apparatus for packaging strand comprising:

a wound strand package;

means for linearly advancing the strand from one end of the package along a given path;

motion detection means effective to sense movement of the strand during its linear advancement including movably mounted guide member upon which the linear element is turned during advancement and an electrical circuit including a switch for controlling supply of electrical signals from the circuit in response to the movement of the strand, the switch comprising a fixed electrical contact and an electrical conductor carried by and moving with the movable guide member, such electrical conductor including a portion projecting from the guide member so that such portion will be moved by the strand during its advancement to intermittently contact the fixed electrical contact and thereby supply intermittent pulse-like electrical signals having a varying frequency and period of duration and fixed amplitude corresponding in frequency and period of duration to the opening and closing of the switch by the strand; and another electric circuit responsive to the varying frequency of the intermittent pulse-like signals for controlling the strand advancing means, whereby the advancement of the strand will be stopped when the frequency of the signal is less than a predetermined frequency.

6. Apparatus of claim 5 in which the movable member of the motion detection means includes means defining a guide opening through which the strand is advanced.

7. Apparatus of claim 6 in which the movable means is immediately adjacent to the end of the package from which the strand is advanced.

8. Apparatus of claim 7 in which the package has a hollow central region from which the strand is withdrawn.

9. Apparatus for packaging roving formed from a plurality of individual strands comprising:

a plurality of strand serving packages each mounted for linear withdrawal of a strand from one end thereof;

a rotatable collector spaced from the serving packages upon which the roving is wound as a package;

means for rotating the collector;

gathering means between the packages and the collector for combining the strands into the roving;

motion detection means for each of the strand effective to sense strand movement during strand withdrawal, each of the motion detecting means including an elongated guide member pivotally mounted at one end, such guide member defining a guide opening intermediate its ends through which a strand is advanced to turn on the member and an electric circuit including a switch for controlling supply of electrical signals in response to movement of the strand, the switch comprising a fixed electrical contact and an electrical conductor carried by and moving with the pivotally mounted guide member, such electrical conductor including a portion projecting from the other end of the elongated guide member such that the projecting portion will be moved by the strand during its advancement to intermittently contact the fixed electrical contact and thereby supply intermittent pulse-like electrical signals having a varying frequency and period of duration and a fixed amplitude corresponding in frequency and period of duration to the opening and closing of the switch by the strand; and another electrical circuit responsive to the frequency of each of the intermittent pulse-like electrical signals for interrupting the rotation of the collector when the frequency of at least one of the electrical signals falls below a predetermined number.

10. Apparatus of claim 9 in which each of the detection means further includes resilient means urging the movable electrical contact member into spaced apart relation with the fixed contact.

11. Apparatus of claim 10 in which the resilient means includes opposing springs.

* * * * *